United States Patent [19]

Samuelson

[11] Patent Number: 4,897,156

[45] Date of Patent: Jan. 30, 1990

[54] PROCESS FOR ACTIVATING CELLULOSE PULP WITH NO AND/OR $NO_2$ AND OXYGEN IN THE PRESENCE OF NITRIC ACID AND THEN DELIGNIFYING BLEACHING THE ACTIVATED CELLULOSE PULP

[75] Inventor: Hans O. Samuelson, Gothenburg, Sweden

[73] Assignee: Mo och Domsjo Aktiebolag, Ornskoldsvik, Sweden

[21] Appl. No.: 361,289

[22] Filed: Mar. 24, 1982

[30] Foreign Application Priority Data

Sep. 21, 1981 [SE] Sweden ..... 8105552

[51] Int. Cl.[4] ..... D21C 3/16

[52] U.S. Cl. ..... 162/65; 162/78; 162/81

[58] Field of Search ..... 162/78, 65, 81, 90

[56] References Cited

U.S. PATENT DOCUMENTS 4,076,579 2/1978 Brink ..... 162/81

FOREIGN PATENT DOCUMENTS 1070909 8/1978 Canada ..... 162/81
0487188 10/1973 U.S.S.R. ..... 162/81
0642399 1/1979 U.S.S.R. ..... 162/81

OTHER PUBLICATIONS

Singh, "The Bleaching of Pulp, 3rd ed.", Tappi Press; Atlanta.

*Primary Examiner*—Steve Alvo

[57] ABSTRACT

A process is provided for activating cellulose pulp using NO and/or $NO_2$ plus oxygen gas in the presence of nitric acid, added in an amount within the range from about 0.1 to about 1.0 gmole per kg of water accompanying the cellulose pulp at a temperature within the range from about 40° to about 120° C. for a time at an activating temperature of 40° to 50° C. of from 15 to 180 minutes, at from 50° to 90° C. of from 5 to 120 minutes, and at higher temperatures of from 1 to 10 minutes, followed by washing, and delignifying bleaching in an alkaline medium with or without oxygen gas and/or peroxide.

18 Claims, No Drawings

PROCESS FOR ACTIVATING CELLULOSE PULP WITH NO AND/OR $NO_2$ AND OXYGEN IN THE PRESENCE OF NITRIC ACID AND THEN DELIGNIFYING BLEACHING THE ACTIVATED CELLULOSE PULP

It is well known that chlorine containing bleaching agents give rise to chlorinated aromatic substances and bioaccumulatable chlorinated substances during the bleaching. If these are discharged with waste bleaching liquor into streams and lakes, they are taken up by fish. These substances cannot be destroyed by biological purification of the sewage water. Some chlorinated byproduct substances have been found to be mutagens.

Consequently, disposal of chlorine-containing waste bleaching liquor from bleaching plants constitutes a very serious problem. Efforts have been made to reduce the use of free or elementary chlorine in the bleaching of cellulose pulp by use of chlorine dioxide instead. The production of chlorine dioxide requires about three times as much electrical energy per kilogram of active chlorine as elementary chlorine.

Nitrogen dioxide has been proposed as a substitute for chlorine in the bleaching delignification of cellulose pulp, and has been studied by Clarke (*Paper Trade Journal*, Tappi. Sect. 118 62 (1944)). Clarke has found that cellulose pulp can be partially delignified by treating the pulp in an aqueous suspension for from 1 to 1.5 hours at 90° C. with nitrogen dioxide, followed by extraction at 90° C. for 30 minutes, or at 50° C. for 60 minutes at a 7% pulp consistency and an alkali charge corresponding to 2% NaOH, calculated on the dry weight of the pulp. The treatment results in a severe depolymerization of the cellulose, which is reflected in a very low viscosity of the treated pulp, compared with pulp subjected to chlorination and alkali extraction.

Bourit (French patent specification No. 2,158,873) avoids depolymerization by applying a delignification process in which the pulp is treated with nitrogen dioxide at low temperature, preferably a temperature below 20° C., and for a long period of time, followed by an alkali extraction under mild conditions. The cellulose pulp is only delignified to a very small extent, however, and the method does not afford any solution to existing environmental problems.

The delignification of lignocellulosic material by treatment with nitrogen dioxide, followed by washing with water, treatment with alkali, and subsequent treatment with oxygen gas, has also been proposed in Swedish patent application No. 77 05136-5. However, this technique has not been put into commercial practice, because although enabling a high degree of delignification, the method causes a drastic lowering of the viscosity.

Another proposal which has not come into practice has been made in Swedish patent application No. 75 06646-4. This bleaching process includes the steps of (1) treating the cellulosic material with a blend of nitrogen monoxide and nitrogen dioxide with nitrogen monoxide in a molar excess, (2) washing with water, and (3) then treating with alkali, for example, in the presence of oxygen gas, under superatmospheric pressure. The nitrogen dioxide can optionally be generated in situ from nitrogen monoxide and oxygen, in which case the nitrogen monoxide is added in an excess of four times the added molar amount of oxygen. The reaction proceeds under superatmospheric pressure with respect to nitrogen monoxide; for example 7 kp/cm$^2$ is shown in Example 1. The nitrogen oxides are removed by depressurizing, followed by evacuation. In every Example, a superatmospheric pressure is employed in the handling of the nitrogen oxides. The handling problems remain, with a great risk of injury to both the internal and external surroundings, and a high consumption of nitrogen oxides. This method also results in a considerable lowering of the viscosity, although it does enable a high degree of delignifiction to be obtained.

When the pretreatment with nitrogen oxide is followed by an oxygen gas bleaching stage, it is said to be suitable, subsequent to displacing or washing from the pulp pulping liquor derived from a pulping process with the use of waste liquor derived from the oxygen gas bleaching, to wash the pulp with the acid washing liquid obtained in the washing stage after the pretreatment. When the acid washing liquid is not washed from the pulp before treating the pulp with nitrogen dioxide, the pH of the liquid is reported to be 2.0, which corresponds to about 0.01 gmole nitric acid, calculated per kg of water in the pulp. The prime object of the method is to remove harmful metal compounds from the pulp.

In summary, the pretreatment of cellulose pulp with nitrogen dioxide $NO_2$ before an oxygen gas bleaching makes possible a more complete delignification and an improved oxygen gas bleaching, without deterioration in the paper-making properties of the pulp. The patent literature indicates that nitrogen monoxide NO gives a like effect. However, relatively large quantities of nitrogen oxides and starting material (ammonia) for the manufacture of said oxides, respectively, are consumed in the process.

In accordance with Samuelson, U.S. Ser. No. 270,438, filed June 4, 1981, now U.S. Pat. No. 4,439,271, the activation stage is carried out with nitrogen dioxide gas in the presence of oxygen gas in an amount such that nitrogen monoxide formed as an intermediate is consumed, while regulating the amount of oxygen gas that is added in such a manner that at the conclusion of the activation stage practically all of the nitrogen monoxide and nitrogen dioxide have been consumed.

That invention accordingly provides a process for the treatment of cellulose pulp with nitrogen dioxide $NO_2$ adapted for application before an oxygen gas bleaching to make possible a more complete delignification and an improved oxygen gas bleaching, without deterioration in the paper-making properties of the pulp, which comprises subjecting the cellulose pulp to an activation reaction with nitrogen dioxide gas in the presence of water and pure oxygen gas in an amount within the range from about 0.1 to about 5 moles per mole of $NO_2$ and in an amount within the range from about 0.6 to about 5 moles per mole of NO, so that nitrogen monoxide formed in the activation is utilized in the activation reaction.

That invention also provides a process for the delignification of cellulose pulp, including chemical pulp prepared from the digestion of lignocellulosic material, which comprises bringing the cellulose pulp in an activation stage in the presence of water and in contact with a gas phase containing nitrogen dioxide and modifying the lignin of the cellulose pulp by reaction with nitrogen dioxide; adding oxygen gas to the activating reaction in an amount within the range from about 0.1 to about 5 moles per mole of $NO_2$ and in an amount within the range from about 0.5 to about 5 moles per mole of NO, so that nitrogen monoxide formed in the activation is utilized in the activation reaction; and then in a second stage, subjecting the pulp to an oxygen gas bleaching in the presence of an alkaline-reacting neutralization medium or neutralizing agent.

In accordance with Samuelson, U.S. Ser. No. 330,406, filed December 14, 1981, and now abandoned, cellulose pulp produced by chemically pulping lignocellulosic material is contacted in an activating stage in the presence of water with a gas phase containing $NO_2$ and oxygen gas, which is supplied in order to utilize the intermediate product NO for activation; and thereafter the pulp is subject to an alkali treatment, both the activating stage and the alkali treatment stage being carried out under drastic conditions, at such high temperature during the activating stage as to obtain a certain degree of degradation of the cellulose molecule, and at a temperature during the alkali treatment process within the range from about 95° to about 150° C., suitably from 101° to 140° C., preferably from 110° to 120° C., the treatment time at 95° C. exceeding 45 minutes, at 101° C. exceeding 30 minutes, and at 110° C. exceeding 15 minutes.

The change in the intrinsic viscosity of the cellulose pulp is used as a measurement of the extent to which the cellulose molecules have been degraded. The viscosity values given therein have all been determined without removing lignin and hemicelluose, which is the most reproducible method for pulps with a moderate lignin content (for example with sulfate pulps having a Kappa number below 35).

This process has however the disadvantage that it requires a very high alkali charge, and results in a high loss of carbohydrates, if the two-stage process is carried far enough to achieve a low lignin content.

In accordance with Samuelson, U.S. Ser. No. 358,998 filed March 17, 1982, and now abandoned, residual lignin in cellulose pulp produced by chemically pulping lignocellulosic material is removed while maintaining good pulp quality by contacting the cellulose pulp in an activating stage in the presence of water with a gas phase containing $NO_2$ and oxygen gas at a temperature within a range from about 40° to about 100° C. sufficient to obtain a degradation of the cellulose molecules resulting in a reduction in the intrinsic viscosity of the cellulose pulp during the activation stage within the range from about 2 to about 35% compared to the intrinsic viscosity prior to the activation and then subjecting the pulp to an oxygen gas-alkali-treatment at a temperature within the range from about 80° to about 150° C., at an oxygen partial pressure within the range from about 0.005 to about 0.18 MPa.

A partial pressure of 0.18 MPa with respect to oxygen gas during a major part of the oxygen gas-alkali-treatment affords rapid delignification and good selectiveity, while delignification at 0.005 MPa takes place very slowly. At a partial pressure below 0.005 MPa, the bleaching is reduced, and the brightness of the pulp is impaired. The pulp acquires a greyish color, but pulp treated at a higher oxygen gas pressure becomes a pure yellow color. In addition, the pulp yield decreases at low oxygen pressure.

In accordance with the invention, a process is provided for activating chemical cellulose pulp and then delignifying bleaching the activated pulp, which comprises treating chemical cellulose pulp in an activating stage with nitrogen oxides in the form of $NO_2$ and/or NO and/or polymer forms and double-molecules thereof, such as $N_2O_4$ and $N_2O_3$, and with an oxygen-containing gas in the presence of nitric acid added in an amount within the range from about 0.1 to about 1.0, suitably from 0.15 to 0.80, and preferably from 0.25 to 0.60, gmole per kg of water accompanying the cellulose pulp at a temperature within the range from about 40° to about 120° C., suitably from 50° to about 100° C., preferably from 55° to about 90° C. for an activating time at an activating temperature of from 40° to 50° C. of from about 15 to about 180 minutes, at a temperature of from 50° to 90° C. of from about 5 to about 120 minutes, and at temperatures about 90° C. from 1 to about 10 minutes, followed by a washing and at least one delignifying stage in an aqueous alkaline medium, either in the presence or in the absence of oxygen gas and/or peroxide.

The combination of these nitrogen oxides and nitric acid provides an activating effect which results in a greatly improved delignification after the alkaline delignifying stage. The delignifying effect obtained in accordance with the invention with 2% $NO_2$ by weight of the dry pulp is approximately the same as that obtained with twice the amount of $NO_2$, if no nitric acid is added. This is surprising, since treatment of the pulp with nitric acid in a concentration within the stated range prior to the alkaline stage, without any addition of $NO_2$ and/or NO, has no appreciable effect on the delignification. The activating effect is obtained irrespective of whether or not oxygen or peroxide is present in the alkaline delignifying stage.

It is surprising that when a suitable amount of nitric acid is prsent during the activating stage, depolymerization of the carbohydrates, primarily in cellulose, is slowed down in the alkaline delignifying stage when the alkaline medium constitutes an oxygen gas delignifying medium. Thus, under optimum conditions while there is a certain depolymerzation (loss in viscosity) in the activating stage, a pulp is nonetheless obtained whose viscosity after the alkaline oxygen gas delignifying stage, not only when compared at the same lignin content (Kappa number) of the pulp but also when compared at the same reaction time in the oxygen gas stage, is markedly higher than that of pulp similarly activated, but without nitric acid being added during the activating stage. Obviously, when an optimum amount of nitric acid is present, the activation provides a chemical reaction which greatly inhibits the degradation of cellulose in the subsequent alkaline oxygen gas bleaching stage.

As a measurement of the degradation of cellulose molecules, there is used here the change in the intrinsic viscosity of the cellulose pulp, determined in accordance with SCAN-C15:62. In the case of fully bleached paper pulps, the viscosity normally should not be less than 900 $dm^3/kg$. All of the viscosities given below have been determined without lignin and hemicellulose having been removed, which is the most reproducible method, in the case of pulps having moderate lignin contents. However, it should be observed that lignin and hemicellulose contribute only slightly to the viscosity in comparison with the same amount of weight of cellulose molecules, and that delignification and bleaching are intended to decrease the lignin content. An appreciable loss of hemicellulose can also occur, while the loss of pure cellulose is very small under the conditions used. Consequently, in those cases where depolymerization of the cellulose is negligible, the intrinsic viscosity will increase. With pine sulfate pulps of the kind used in the majority of Examples given herein, a decrease in the Kappa number of 10 units results in an increase in viscosity of about 50 $dm^3/kg$, under those conditions where depolymerization of the cellulose can be ignored, while a corresponding increase in the case of sulfite pulp and hardwood sulfate pulp is markedly higher because more hemicellulose is lost.

The nitrogen dioxide can be supplied as substantially pure $NO_2$. $NO_2$ can also be formed in situ in the reactor upon charging nitric oxide and oxygen thereto. $NO_2$ plug NO may also be supplied. Dinitrogen tetroxide ($N_2O_4$) and other polymeric nitrogen dioxide forms are considered to be included in the term "nitrogen dioxide" ($NO_2$). One mole of dinitrogen tetroxide is considered to be the same as two moles of nitrogen dioxide. Adducts in which nitric oxide is present are considered in the same manner as nitric oxide. Thus, dinitrogen trioxide ($N_2O_3$) is considered as one mole of nitric oxide and one mole of nitrogen dioxide. Adducts in which oxygen is present probably occur as intermediates.

The amount of nitrogen oxides charged is adapted to the lignin content, the desired degree of delignification, and the tolerable attack on the carbohydrates. Calculated as monomers, the amount is normally within the range from about 0.1 to about 4, suitably from 0.3 to 2, preferably from 0.5 to 1.2, kilogrammoles calculated per 100 kg lignin in the pulp entering the activating stage.

A certain amount of oxygen gas must be supplied to the activating stage, both when nitrogen dioxide ($NO_2$) is charged and when nitric oxide (NO) is charged. This oxygen-containing gas may be air.

In order to obtain the best possible results with the simplest apparatus possible, it is suitable to supply the oxygen to the activating stage in the form of a substantially pure oxygen gas. Liquid oxygen can also be supplied to the activating stage, and vaporized, e.g., when entering the reactor in which the activating process is carried out. The use of substantially pure oxygen results in a lower content of NO plug $NO_2$ in the gas phase than when air is used. It also means that only a minor quantity of inert gas needs to be removed from the reactor, and optionally treated to render residual gases harmless.

The amount of oxygen added to the activating stage is selected according to the amount of nitrogen oxides added, so that the addition of $O_2$ per mole of $NO_2$ amounts to at least 0.08, suitably from 0.1 to 2.0, preferably from 0.15 to 0.30, mole If NO or a mixture of NO and $NO_2$ is used instead, the oxygen gas addition is so made that the amount of oxygen is at least 0.60, suitably from 0.65 to 3.0, preferably from 0.70 to 0.85, mole $O_2$ per mole of NO charged. When NO is used the charge is preferably made batchwise or continuously in a manner such that oxygen is supplied in portions or continuously before the supply of NO is terminated. In this way, activation is more uniform than when oxygen gas is not supplied until all NO has been charged to the reactor. The reactor can be designed for batchwise operation, or for continuous operation in a reaction zone with continuous feed-in, transit through and delivery of cellulose pulp from the continuous zone, and the supply of gases thereto.

Nitric acid can be added to the activating stage when activation with nitrogen oxides and with oxygen-containing gas has been completed. For example, the cellulose pulp can be flushed out from the activating reactor vessel or from a zone thereof with nitric acid. Nitric acid can also be supplied during treatment with the aforementioned gases.

It has been found most suitable for delignification to supply the acid to the pulp before the pulp is brought into contact with nitrogen oxides. Impregnation with excess nitric acid and removal of the excess, for example, by filtration and/or pressing, is a preferred embodiment. Irrespective of how the acid is added, it is advantageous for the pulp containing the nitric acid to be subjected to activation with nitrogen oxides and oxygen-containing gas at a pulp consistency within the range from about 15 to about 80%, suitably from 20 to 70%, preferably from 26 to 45%. The stated pulp consistency should be maintained for at least 50% of the activating time. The pulp consistency can be maintained over the whole of the activating time to great advantage. When the supply of gases to the activating stage has been substantially completed, dilution with water or preferably nitric acid can be made, which can afford advantages in the case of certain types of pulp.

One characteristic result of the process according to the invention is that more nitric oxide and nitrogen dioxide is obtained in the gas phase than when no nitric acid is present, with the same addition of nitrogen oxides and oxygen gas, and the reaction parameters in other respects also being equal. An increased pulp consistency and an elevated temperature also result in an increase in residual $NO_2$ and/or NO gas content. Tests have shown that the moisture content of the pulp, the temperature of the activating stage and the addition of nitric acid, nitrogen oxides and oxygen gas should be so adapted that after one-half the activating time, the amount of NO plus $NO_2$ in the gas phase amounts to at least 0.05 mmole per liter of gas, measured at atmospheric pressure and 25° C. When producing pulps having a high degree of delignification, the amount of NO plus $NO_2$ in the gas phase should be at least 0.1 and preferably at least 0.15 mmole per liter.

It has been found that the major part of the nitrogen oxides added are consumed very rapidly when there is a surplus of oxygen gas in the reactor vessel, and that the rate of consumption is very slow towards the end of the activation period. This is due to the fact that nitric oxide is split off from the cellulose pulp as a result of some unknown reaction. This previously unknown reaction is favored in some way by the nitric acid present, and seems to explain the surprising technical effects achieved by the addition of nitric acid in accordance with the invention. The presence of oxygen gas is a prerequisite for achieving these effects.

It is particularly suitable to charge $NO_2$ and/or NO in the vicinity of the feed-in or inlet end of a continuous activating stage. In order to obtain the best possible activation and utilization of the nitrogen oxides supplied, and the least possible gas effluent, and as little trouble as possible with rendering unconsumed nitric oxide and nitrogen dioxide harmless, in the case of a continuous activating stage, oxygen gas, preferably the major part of the oxygen gas, should be fed in at one or more zones located in the vicinity of the outlet end of the reactor. Suitably, the oxygen gas is supplied to a zone which is so located that the retention time of the advancing pulp corresponds to 70 to 100, suitably 80 to 100, preferably 90 to 100%, of the total retention time in the activating stage.

It has also been found advantageous to lower the temperature of the cellulose pulp later in the activating stage, for example, when 80% of the activating time has passed. This lowering of the temperature may advantageously be so effected that the temperature of the pulp is less than 40° C., for example, within the range from about 10° to about 35° C., suitably from 20° to 30° C., and the retention time at a temperature below 40° C., for example, from 10 to 120 minutes, preferably from 15 to 60 minutes.

The time at which the temperature is below 40° C. is not included in the time ranges above. Any cooling required to reduce the temperature can be effected indirectly, for example, by cooling the gas phase, or by introducing cold oxygen, for example, liquid oxygen, to the activating stage. Water can also be evaporated by lowering the pressure.

When activation is effected continuously, the feed-in of inert gas into the reactor and the discharge of gas from said reactor should effectively be prevented. This can be achieved by providing known gas sluices for the pulp at the feed-in end and at the feed-out end of the vessel.

The total gas pressure (including steam) in the reactor is suitably held at about atmospheric pressure, preferably at a low subatmospheric pressure corresponding, for example, to from about 0.001 to about 0.01 MPa.

It has been found particularly suitable to discharge the cellulose pulp from the activating stage by flushing with water and/or an aqueous solution. In accordance with one preferred embodiment, the flushing water is waste liquor recovered from the process and containing nitric acid and an organic substance.

The major part of the nitrogen oxides supplied in accordance with the method according to the invention gives rise to nitric acid. According to a preferred embodiment, the nitric acid used in the activating stage is recovered either completely or partially from the pulp discharged from the activating stage. The nitric acid can be recovered in a known manner, for example, by washing and/or displacement. The acid can also be recovered by pressing the pulp, preferably subsequent to dilution with water and/or an aqueous solution. Advantageously, recovery of the acid is effected in accordance with the countercurrent flow principle, such that, after the activating stage, the pulp is brought into contact with waste liquor from said stage containing nitric acid.

According to a further embodiment, which has been found to provide a better result than when pure nitric acid is charged to the activating stage, the waste liquor containing nitric acid recovered from the activating stage is used to impregnate the cellulose pulp added to the activating stage. Impregnation of the pulp is suitably effected by passing the in going pulp in countercurrent flow with the waste liquor, so that the pulp is progressively brought into contact with waste liquor of increasing nitric acid concentration. This countercurrent impregnation of the cellulose pulp is preferably carried out when substantially all cooking liquor originating from the cooking of the cellulosic raw materials has been washed or displaced from the pulp.

In accordance with a preferred embodiment, the cooking liquor present in the pulp is washed or displaced therefrom with waste liquor obtained from the alkaline delignifying stage, this waste liquor being substantially removed when the pulp is impregnated with waste liquor from the activating stage.

When ammonia is used to produce nitric oxide and/or nitrogen dioxide, nitric acid is formed as a by-product. This nitric acid can be used to advantage in the activating process, preferably in combination with waste liquor recovered from the activating stage. The preparation of nitric oxide and nitric acid in situ enables a very uniform reaction to be achieved during the activating process, which can readily be governed through a controlled successive supply of nitric oxide and oxygen, so that the whole of the cellulose pulp comes into effective contact with the gases, and so that local overheating within the reactor is avoided.

By the process according to the invention, it is possible to remove at least 75% of the lignin remaining in the pulp after the pulping, while maintaining good pulp properties. The residual lignin is removed by treating the pulp in accordance with known final bleaching techniques, for example, by using as bleaching agents chlorine dioxide, hypochlorite and optionally, chlorine.

A number of advantages are obtained when treating cellulose pulp in accordance with the invention. The most important of these advantages is that the cost of chemicals for the activating stage is greatly reduced, in comparison with previously known techniques. This saving in chemicals is expressed in different ways, depending on whether commercial nitrogen oxides are used (nitrogen dioxide can be bought as a commercial product) or whether the nitrogen oxides are produced from ammonia by oneself.

Thus, when practicing the process according to the invention, and using commercial nitrogen dioxide, the amount required is only half that which would otherwise be necessary. The nitric acid required is obtained more or less free, since nitric acid is generated during the activating stage, and can be recovered upon the completion of said stage. Initially, it may be necessary to purchase fresh nitric acid, but the amount required will never by cost-significant.

If the nitric oxide and/or nitrogen dioxide is produced in-house, using ammonia as a starting chemical, a considerable amount of nitric acid is formed at the same time. The invention makes use of this nitric acid, which would otherwise be difficult to dispose of. Thus, the installation of a plant for the production of nitrogen oxides in connection with the bleach plant is a feasible proposition, and reduces the costs for activating chemicals to a minimum.

The following Examples represent preferred embodiments of the invention.

EXAMPLES 1 to 8

Activating Stage

A pine sulfate pulp having a Kappa number of 33.5 and an intrinsic viscosity of 1185 $dm^3/kg$ was pressed to a solids content of 39%. The pulp ws then impregnated with nitric acid by mixing for ten minutes at room temperature with an amount of nitric acid corresponding to 0.4 g mole per kg of water in the pulp. As a result, the consistency of the pulp was reduced to 30%.

The pulp was charged to a rotary reactor, which was then evacuated and heated to a temperature of 58° C. over ten minutes. 2% $NO_2$ by weight of the bone dry pulp was then charged by vaporizing liquid $N_2O_4$ in the evacuated reactor. Oxygen gas was charged to the reactor in three portions over a period of two minutes to bring the pressure in the reactor to atmospheric pressure. Five minutes after the charge of $NO_2$ was begun, the temperature was reduced to 50° C., and this temperature was maintained for 55 minutes. The reactor was then cooled to 30° C. over fifteen minutes, and then the pulp was flushed from the reactor with cold water, halting the treatment. The total time for the treatment was thus 75 minutes, including the time taken to cool the reactor. These are Examples 1,2,3 and 4.

Four additional experiments were made in accordance with the invention, and these are Examples 5,6,7 and 8. These activating treatments were carried out in a similar manner to Examples 1 to 4, except that the temperature was maintained at 50° C. over the whole of the activating stage.

Four Control activating treatments were made, these being denoted A, B, C and D, under conditions the same as those in Examples 5 to 8, except that water was added to the pulp prior to the activating stage instead of nitric acid.

Four Control activating treatments were also made, Controls E, F, G and H, with a charge of 4% $NO_2$ without the addition of nitric acid. the same conditions after the activating stage were used as those in the others. The whole $NO_2$ charge was then made over a period of two minutes, and then oxygen gas was charged in three portions for two minutes, to bring the pressure to atmospheric pressure. The temperature was kept constant at 50° C. for 75 minutes.

Four additional Control activating treatments, Controls I, J, K and L were made with a first charge of 2% $NO_2$ at 65° C. After five minutes the pulp was cooled to 50° C. and a further 2% charge of $NO_2$ was made. After fifteen minutes, calculated from the time at which the charge of $NO_2$ was begun, $O_2$ was charged in three portions for two minutes, to bring the pressure to atmospheric pressure. After a total activating time of sixty minutes, the pulp was cooled to 30° C. After a total time of 75 minutes, the activating process was interrupted as before.

Table I shows the most important parameters in the activating stage, and the pulp properties achieved during these experiments, all of which were carried out at a total time of 75 minutes.

In order to estimate the degradation of the carbohydrates and the formation of readily soluble lignin during the activating stage, samples of the pulp were taken after the treatment, and washed with 0.2 M aqueous $NaHCO_3$ solution at room temperature, and then with water. Subsequently, the samples were dried rapidly in a stream of air at 35° C. The results of these are given in Table I.

TABLE I

| | Charged Amount | | | | After $NaHCO_3$ wash | |
|---|---|---|---|---|---|---|
| | $NO_2$ % | $HNO_3$ g mole/kg $H_2O$ | Highest temperature °C. | $NO_2$-content[1] in the gas phase mmole/l | Kappa Number | Viscosity $dm^3/kg$ |
| Example No. | | | | | | |
| 1 to 4 | 2 | 0.4 | 58 | 0.12 | 22.3 | 1100 |
| 5 to 8 | 2 | 0.4 | 50 | 0.19 | 22.7 | 1098 |
| Controls | | | | | | |
| A to D | 2 | 0 | 50 | 0.02 | 27.9 | 1181 |
| E to H | 4 | 0 | 50 | 0.18 | 23.0 | 1124 |
| I to L | 4 | 0 | 65 | 0.09 | 25.0 | 1127 |

[1]Measured at the end of the treatment.

Alkaline Oxygen Bleaching Stage

The activated pulp from each of Examples 1 to 4, 5 to 8, and Controls A to D, E to H, and I to L was then washed with cold water and separated into batches corresponding to the Examples in these five groups. These batches were each subjected to an oxygen gas bleaching process at a pulp consistency of 26% for a period of sixty minutes and at a temperature of 106° C. Pure oxygen gas was used, and the oxygen partial pressure was 0.11 MPa, measured at 106° C. Alkali in the form of pure sodium hydroxide was charged to the batches in each group in a quantity of 1.0, 1.5, 2.5 and 4.0%, respectively, as shown in Table II, by weight of the dry unbleached pulp. In addition, there was charged to each batch magnesium complex with spent bleaching liquor in an amount corresponding to 0.2% Mg, calculated in the same manner as above.

TABLE II

| | Oxygen gas bleached pulp produced with varying charges of NaOH | | |
|---|---|---|---|
| Example No. | NaOH % | Kappa Number | Viscosity $dm^3/kg$ |
| 1 | 1.0 | 13.2 | 1038 |
| 2 | 1.5 | 10.8 | 1031 |
| 3 | 2.5 | 9.1 | 1014 |
| 4 | 4.0 | 8.2 | 936 |
| 5 | 1.0 | 13.9 | 1034 |
| 6 | 1.5 | 11.7 | 1040 |
| 7 | 2.5 | 9.3 | 1011 |
| 8 | 4.0 | 8.5 | 941 |
| Controls | | | |
| A | 1.0 | 21.0 | 1076 |
| B | 1.5 | 15.0 | 1068 |
| C | 2.5 | 12.4 | 990 |
| D | 4.0 | 10.4 | 845 |
| E | 1.0 | 15.3 | 1045 |
| F | 1.5 | 12.7 | 1055 |
| G | 2.5 | 10.4 | 1034 |
| H | 4.0 | 8.6 | 953 |
| I | 1.0 | 16.1 | 1050 |
| J | 1.5 | 12.9 | 1057 |
| K | 2.5 | 10.8 | 1038 |
| L | 4.0 | 9.8 | 935 |

As seen from Table I, in the case of Controls A to D where the pulp was washed with sodium bicarbonate, an insignificant reduction in the intrinsic viscosity was obtained when nitric acid was not added prior to the $NO_2/O_2$ treatment process. Furthermore, a lower content of $NO_2$ in the gas phase was obtained than in Examples 1 to 8. In Examples 1 to 8 the viscosity was markedly lowered, which is of course a disadvantage, as is also the higher residual $NO_2$ gas content. An increase in the formation of readily soluble lignin is reflected in the lower Kappa number of the pulps washed with sodium bicarbonate, which pulps were activated in the presence of nitric acid, than in Controls A to D in the presence of water.

Examples 1 to 8 showed a large increase in the degree of delignification , in comparison with Controls A to D after the oxygen gas stage, particularly in the case of the lower charges of NaOH. These pulps were impregnated with nitric acid prior to charging nitrogen dioxide. The effect was so great that the selectivity, defined as the viscosity at a given Kappa number, was much higher in Examples 1 to 8 than in the Controls A to L, in which no nitric acid was used. It is of particular interest to note that when the larger quantities of sodium hydroxide were charged (2.5 and 4%, Examples 3, 4, 7 and 8) the viscosity of the oxygen gas bleached pulps, despite the marked lowering of the viscosity during the activating stage, when said stage was carried out after adding nitric acid, was appreciably higher after a given period of time with constant conditions in the oxygen gas bleaching stage.

The experiments show firstly that in accordance with the invention there is obtained an improved delignification, and secondly that the special conditions during the activating stage result in a strong retardation of the depolymerization of the carbohydrates, primarily depolymerization of the cellulose, during a subsequent oxygen gas bleaching stage.

A somewhat higher selectivity and lower Kappa number with the same alkali charge was obtained according to the invention, when the highest temperature was 58° C. and the temperature lowered during the activating stage (Examples 1 to 4) than when the entire activating stage was carried out at a temperature of 50° C. (Examples 5 to 8). In addition, far less nitrogen dioxide was obtained in the gas phase at the end of the activating time, which represents an appreciable advantage with respect to pollution of the environment. Separate experiments have shown that a further reduction in the temperature to 22° C. and an increased contact time between the gas phase and the pulp at a low temperature in the final stage of the activating stage (after treatment) results in a further lowering of the residual gas content.

As expected, in Controls E to L, with 4% $NO_2$, a much higher degree of delignification was obtained than when using 2% $NO_2$. The Kappa numbers, however, were consistently higher than those reached after the same treatment process in the alkali stage, when the pretreatment process was carried out in accordance with the invention with half the amount of $NO_2$ charged. Compared at the same Kappa number, the differences in viscosity between the Controls using 4% $NO_2$ and Examples 1 to 8 using 2% $NO_2$ were hardly significant. Since nitric acid is formed by the nitrogen dioxide charged, and can be recovered for use in the process, the invention enables a reduction by about 50% in the charge of chemicals to the activating stage, in comparison with previously known techniques.

In another series of Controls, Controls M, N, O and P, the pulp was impregnated with hydrochloric acid instead of nitric acid, to give an HCl concentrtion of 0.4 g mole per kg of water in the impregnated pulp. In other respects, the Controls were carried out in the same manner as the Examples 5 to 8. After washing with sodium bicarbonate, the Kappa number was only 1.2 units lower than in the Controls A to L carried out with water, i.e., markedly higher than in Examples 1 to 8, using nitric acid, while the viscosity was 22 units lower than in corresponding Examples 1 to 8 with nitric acid.

After oxygen gas bleaching the pulp, the Kappa number differed on average by less than 5% from the Controls A to L with water, a difference which has hardly any significance, while powerful degradation of cellulose ws reflected in the viscosity values, which were 60 to 80 units lower than in Controls A to L using water. Thus, the selectivity was even worse than Controls A to L, with no acid present. Consequently, nitric acid cannot be replaced with hydrochloric acid or any other acid. The Controls show that the more effective delignification obtained in the presence of nitric acid at the given concentrations is not dependent on an acid hydrolysis of lignin bonds.

EXAMPLES 9 to 14

A sulfate pulp of softwood, mainly pine, having a Kappa number of 30.7 and an intrinsic viscosity of 1225 $dm^3/kg$, was pressed to a solids content of 31%. The mass was then treated in a glass reactor with 4% $NO_2$ by weight of the dry pulp at 57° C. The reactor was evacuated and heated to 57° C. prior to charging nitrogen dioxide by vaporizing liquid $N_2O_4$. The charge of $NO_2$ required three minutes. Oxygen gas was charged to the reactor in small portions over a period of two minutes, to bring the reactor pressure to atmospheric, and the reactor was rotated for a total reaction time of fifteen minutes.

The activating process was continued by diluting the pulp (without previous washing) with nitric acid of varying concentrations, so that an 8% solids content was obtained. The pulp was permitted to react with the charged nitric acid at varying temperatures and times. The nitric acid was then filtered off, and the pulp washed with cold water.

The pulp was then subjected to a delignifying stage, using a hot alkali treatment in the absence of air or oxygen gas at a pulp consistency of 24%. The alkali charge comprised 5% NaOH, by weight of the bone dry pulp. The temperature was 106° C., and the time 45 minutes. After the hot alkali treatment the pulp was washed with water, and analyzed.

In addition, three Controls, Control Q, Control R and Control S, were run. In Controls Q and R, the pulp subsequent to being treated with $NO_2/O_2$ was diluted with water to a consistency of 8% and the suspension maintained at 40° C. and 60° C., respectively, for sixty minutes.

In Control S, the pulp was washed with cold water and subjected to a hot alkali treatment process immediately after being treated with $NO_2/O_2$ for fifteen minutes at a consistency of 31%.

Controls Q and R showed no appreciable change in Kappa numbers compared to Control S, although a slight lowering of the viscosity compared to Control S can be seen.

The differing parameters during the activating stage and the pulp properties obtained are set forth in Table III.

TABLE III

| Example No. | Charged $HNO_3$ g mole/kg $H_2O$ | Temperature °C. | Time Minutes | Analysis of hot alkali treated pulp: Kappa Number | Viscosity ($dm^3/kg$) |
|---|---|---|---|---|---|
| 9 | 0.2 | 40 | 60 | 12.2 | 1185 |
| 10 | 0.2 | 60 | 60 | 9.1 | 1127 |
| 11 | 0.4 | 40 | 60 | 10.9 | 1200 |
| 12 | 0.4 | 60 | 30 | 10.0 | 1168 |
| 13 | 0.4 | 60 | 60 | 7.8 | 1094 |
| 14 | 0.4 | 60 | 120 | 6.8 | 1046 |
| Control Q | 0 | 40 | 60 | 12.7 | 1208 |
| Control R | 0 | 60 | 60 | 12.4 | 1176 |
| Control S | — | — | — | 12.5 | 1214 |

In Examples 10 to 14 in accordance with the invention, a significant lowering of the Kappa number was obtained compared to Control S. The effect was much greater at 60° C. (Examples 10 and 12 to 14) than at 40°

C. (Examples 9 to 11). At 60° C. there was obtained a marked effect with 0.2 M nitric acid, while the effect was small at 40° C. at this concentration. An increase in the concentration and in the treatment time resulted in improved dilignification, but at the same time in a decrease in the viscosity, which, however, was moderate in comparison with the decrease in the Kappa number.

Normally, a viscosity of 900 $dm^3/kg$ is considered a minimum for a bleached paper pulp of high quality. When the concentration of nitric acid was higher than 1.0 g mole per kg of water, the viscosity decreased below this value under those conditions with respect to time and temperature where a significant effect with respect to delignification was achieved because of the presence of the nitric acid. Thus, when the nitric acid concentration was 1.1 g moles per kg of water, the activating temperature 56° C., and treatment time thirty minutes, the intrinsic viscosity was 849 $dm^3/kg$.

Treatment carried out in accordance with Example 14 results in a significant dissolution of hemicellulose, which is advantageous in the case of special pulps, e.g., in the case of special paper which is required to be particularly resistant to ageing, while a treatment time of 120 minutes with nitric acid (0.4 g mole per kg water) at 60° C. is, in general, much too long to obtain an optimum effect.

EXAMPLES 15 to 22

Activating Stage

A sulfate pulp produced from a mixture of 50% spruce, 40% pine and 10% aspen, having a Kappa number of 34.8 and an intrinsic viscosity of 1196 $dm^3/kg$, was pressed to a solids content of 39%. The pulp was then impregnated with nitric acid by mixing for ten minutes at room temperature with an amount of nitric acid corresponding to 0.3 g mole in Examples 15 to 18 and 0.4 g mole in Examples 19 to 22, per kg of water in the pulp. As a result, the consistency of the pulp was reduced to 30%.

The pulp was charged to a rotary reactor, which was then evacuated and heated to a temperature of 58° C. over ten minutes. 2% $NO_2$ by weight of the bone dry pulp was then charged by vaporizing liquid $N_2O_4$ in the evacuated reactor. Oxygen gas was charged to the reactor in three portions over a period of two minutes to bring the pressure in the reactor to atmospheric pressure. Five minutes after the charge of $NO_2$ was begun, the temperature was reduced to 55° C., and this temperature was maintained for 30 minutes. Then, the pulp was flushed from the reactor with cold water, halting the treatment.

Four Control activating treatments were made, Controls T and U being under the same conditions as above, except that water was added to the pulp prior to the activating stage instead of nitric acid, and Controls V and W being under the same conditions as above, except that 0.08 g mole nitric acid per kg of water was used.

Four Controls activating treatments were also made, Controls X, Y, Z and ZZ, the first two with a charge of 0.4% nitric acid without the addition of $NO_2$, and Controls Z and ZZ without either $NO_2$ or nitric acid. The other conditions were the same.

Table IV shows the most important parameters in the activating stage.

TABLE IV

| Example No. | Charged Amount $NO_2$ % | Charged Amount $HNO_3$ g mole/kg $H_2O$ | Highest temperature °C. | $NO_2$-content[1] in the gas phase mmole/l |
|---|---|---|---|---|
| 15 to 18 | 2 | 0.3 | 55 | 0.23 |
| 19 to 22 | 2 | 0.4 | 55 | 0.32 |
| Controls | | | | |
| T and U | 2 | 0 | 55 | 0.03 |
| V and W | 2 | 0.08 | 55 | 0.04 |
| X and Y | 0 | 0.4 | 55 | 0.01 |
| Z and ZZ | 0 | 0 | 55 | 0 |

[1]Measured at the end of the treatment

Alkaline Oxygen Bleaching Stage

The activated pulp from each of Examples 15 to 18, 19 to 22, and Controls T and U, V and W, X and Y, Z and ZZ, was then washed with cold water and separated into batches corresponding to the Examples in these six groups. These batches were each subjected to an oxygen gas bleaching process at a pulp consistency of 26% for a period of sixty minutes and at a temperature of 106° C. Pure oxygen gas was used, and the oxygen partial pressure was 0.11 MPa, measured at 106° C. Alkali in the form of pure sodium hydroxide was charged to the batches in each group in a quantity of 1.0, 1.5, 2.5 and 4.0%, respectively, as shown in Table V, by weight of the dry unbleached pulp. In addition, there was charged to each batch magnesium complex with spent bleaching liquor in an amount corresponding to 0.2% Mg, calculated in the same manner as above.

TABLE V

| Example No. | Oxygen gas bleached pulp produced with varying charges of NaOH: NaOH % | Kappa Number | Viscosity $dm^3/kg$ |
|---|---|---|---|
| 15 | 1.0 | 16.8 | 1126 |
| 16 | 1.5 | 13.7 | 1089 |
| 17 | 2.5 | 11.3 | 1061 |
| 18 | 4.0 | 10.1 | 984 |
| 19 | 1.0 | 14.3 | 1069 |
| 20 | 1.5 | 12.0 | 1042 |
| 21 | 2.5 | 10.0 | 994 |
| 22 | 4.0 | 8.8 | 972 |
| Controls | | | |
| T | 1.5 | 17.4 | 1040 |
| U | 4.0 | 12.2 | 928 |
| V | 1.5 | 17.5 | 1047 |
| W | 4.0 | 12.0 | 926 |
| X | 1.5 | 22.3 | 998 |
| Y | 4.0 | 14.1 | 992 |
| Z | 1.5 | 22.1 | 991 |
| ZZ | 4.0 | 14.4 | 931 |

As is shown in Table V, delignification was much poorer in Controls T, U, V and W compared with Examples 15 to 22 in accordance with the invention. In the Controls, the concentration of nitrogen dioxide in the gas phase was much lower than in the Examples. Like the gas analysis given in Table, I, these analyses indicate that the nitric acid charged in the Examples carried out in accordance with the invention contributes in an unknown manner to increasing the content of components in the gas phase which promote the activating process.

Controls X and Y show that the introduction of nitric acid without the addition of nitrogen dioxide has an insignificant effect on delignification, under the conditions used in the Examples in accordance with the invention. The results differ insignificantly from those obtained in Controls Z and ZZ, where the sulfate pulp was oxygen gas bleached directly, without any preceding activation.

Having regard to the foregoing disclosure, the following is claimed as the inventive and patentable embodiments thereof:

1. A process for activating chemical cellulose pulp and then delignifying bleaching the activated pulp, which comprises adding and treating the cellulose pulp in an activating stage with added nitrogen oxide selected from the group consisting of nitrogen dioxide, nitrogen monoxide, polymers thereof, and mixtures thereof, and with added oxygen-containing gas in the presence of nitric acid added in an amount within the range from about 0.1 to about 1 g mole per kg of water accompanying the cellulose pulp at a temperature within the range from about 50 ° to about 120° C., the nitrogen oxide, oxygen-containing gas and nitric acid all being present simultaneously, the treatment being under conditions minimizing formation of nitric acid and favoring a high concentration of nitrogen dioxide for an activating time selected according to activating temperature as follows:

(a) at an activating temperature of from 50° to 90° C. of from about 5 to about 120 minutes, and (b) at an activating temperature above 90° C. of from 1 to about 10 minutes;

washing the treated pulp and then subjecting the washed pulp to at least one delignifying stage in an aqueous alkaline medium.

2. A process according to claim 1 in which the amount of added nitric acid is within the range from about 0.15 to about 0.80 gmole per kg of water.

3. A process according to claim 1 in which the amount of added nitric acid is within the range from about 0.25 to about 0.60 gmole per kg of water.

4. A process according to claim 1 in which the temperature is within the range from about 50° to about 100° C.

5. A process according to claim 1 in which the temperature is within the range from about 55° to about 90° C.

6. A process according to claim 1 in which the delignifying stage is carried out in the presence of oxygen gas.

7. A process according to claim 1 in which the delignifying stage is carried out in the absence of oxygen gas.

8. A process according to claim 1 in which the delignifying stage is carried out in the presence of peroxide bleaching agent.

9. A process according to claim 1 in which the nitric acid is added to the cellulose pulp prior to addition of nitrogen oxide.

10. A process according to claim 1 in which the amount of nitrogen oxide charged, calculated as monomer, is within the range from about 0.1 to about 4 kilomoles per 100 kg of lignin in the cellulose pulp.

11. A process according to claim 1 in wich the amount of oxygen added to the pulp in the activating stage is within the range from about 0.08 to about 5 moles $O_2$ per mole of $NO_2$.

12. A process according to claim 11 in which the amount of oxygen is within the range from about 0.65 to about 3 moles $O_2$ per mole of $NO_2$.

13. A process according to claim 1 in which the activation is carried out as a continuous activating stage, and at least the major part of the oxygen gas introduced is added to a zone within the retention time of the advancing pulp within the range from about 70 to about 100% of the total retention time in the activating stage.

14. A process according to claim 1 in which the pulp consistency is within the range from about 15 to about 80% during at least 50% of the activating time.

15. A process according to claim 1 in which the moisture content of the pulp added to the activating stage, the temperature of said stage and the amounts of nitric acid, nitrogen oxides and oxygen gas added thereto are so selected that after half the activating time has passed the concentration of NO plus $NO_2$ in the gas phase is not less than 0.05 mmole per liter.

16. A process according to claim 1 in which the cellulose pulp is cooled to below 40° C. during a final part of the activating stage.

17. A process according to claim 1 in which the cellulose pulp is flushed from the activating stage with water or an aqueous solution.

18. A process according to claim 1 in which the nitric acid is recovered from the pulp leaving the activating stage.

* * * * *